US008690309B2

(12) United States Patent
McConville et al.

(10) Patent No.: US 8,690,309 B2
(45) **Date of Patent: *Apr. 8, 2014**

(54) PRINT PROCESS FOR PHASE SEPARATION INK

(75) Inventors: Paul McConville, Webster, NY (US); Joanne L. Lee, Rochester, NY (US); Peter G. Odell, Mississauga (CA); Sandra J. Gardner, Oakville (CA)

(73) Assignee: Xerox Corporation, Norwalk, CT (US)

( * ) Notice: Subject to any disclaimer, the term of this patent is extended or adjusted under 35 U.S.C. 154(b) by 413 days.

This patent is subject to a terminal disclaimer.

(21) Appl. No.: 13/095,038

(22) Filed: Apr. 27, 2011

(65) Prior Publication Data

US 2012/0274716 A1 Nov. 1, 2012

(51) Int. Cl.

| | |
|---|---|
| ***B41J 2/01*** | (2006.01) |
| ***B41J 11/00*** | (2006.01) |
| ***B41J 2/005*** | (2006.01) |
| ***B41J 2/21*** | (2006.01) |

(52) U.S. Cl.

CPC *B41J 2/01* (2013.01); *B41J 11/002* (2013.01); *B41J 11/0015* (2013.01); *B41J 2/0057* (2013.01); *B41J 2/2107* (2013.01)

USPC ..... 347/101; 347/102; 347/103; 347/100

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; B41J 2/0057; B41J 11/002

USPC ..... 347/100, 96, 95, 101, 102, 88, 99, 103, 347/21, 20; 106/31.6, 31.27, 31.13; 523/160, 161

See application file for complete search history.

(56) References Cited

U.S. PATENT DOCUMENTS

| | | | |
|---|---|---|---|
| 4,251,824 | A | 2/1981 | Hara et al. |
| 4,410,899 | A | 10/1983 | Haruta et al. |
| 4,412,224 | A | 10/1983 | Sugitani |
| 4,490,731 | A | 12/1984 | Vaught |
| 4,532,530 | A | 7/1985 | Hawkins |
| 4,601,777 | A | 7/1986 | Hawkins et al. |
| 5,195,430 | A | 3/1993 | Rise |

(Continued)

FOREIGN PATENT DOCUMENTS

EP 0 941 855 B1 7/2005

OTHER PUBLICATIONS

Rina Carlini, et al., U.S. Appl. No. 13/095,174, filed Apr. 27, 2011, "Ink Compositions Incorporating Substituted Oxazoline Compounds or Substituted Oxazoline Derivaties," not yet published, 81 pages.

(Continued)

*Primary Examiner* — Manish S Shah
(74) *Attorney, Agent, or Firm* — Marylou J. Lavoie

(57) ABSTRACT

A process including disposing at least one phase separation ink in an imagewise fashion onto a final image receiving substrate to form an ink image, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; wherein the amorphous phase of the at least one phase separation ink substantially penetrates into the final image receiving substrate; and wherein the crystalline phase of the at least one phase separation ink substantially remains on the surface of the final image receiving substrate; applying pressure to the ink image on the final image receiving substrate; and allowing the ink to complete crystallization.

18 Claims, 4 Drawing Sheets

(56) References Cited

U.S. PATENT DOCUMENTS

| | | | | |
|---|---|---|---|---|
| 5,231,135 | A | 7/1993 | Machell et al. | |
| 5,372,852 | A | 12/1994 | Titterington et al. | |
| 5,389,958 | A | 2/1995 | Bui et al. | |
| 5,621,022 | A | 4/1997 | Jaeger et al. | |
| 5,698,017 | A | 12/1997 | Sacripante et al. | |
| 5,817,169 | A * | 10/1998 | Sacripante et al. | 106/31.43 |
| 6,221,137 | B1 | 4/2001 | King et al. | |
| 6,472,523 | B1 | 10/2002 | Banning et al. | |
| 6,476,219 | B1 | 11/2002 | Duff et al. | |
| 6,547,380 | B2 | 4/2003 | Smith et al. | |
| 6,576,747 | B1 | 6/2003 | Carlini et al. | |
| 6,576,748 | B1 | 6/2003 | Carlini et al. | |
| 6,590,082 | B1 | 7/2003 | Banning et al. | |
| 6,646,111 | B1 | 11/2003 | Carlini et al. | |
| 6,663,703 | B1 | 12/2003 | Wu et al. | |
| 6,673,139 | B1 | 1/2004 | Wu et al. | |
| 6,682,587 | B2 | 1/2004 | Hendricks et al. | |
| 6,696,552 | B2 | 2/2004 | Mayo et al. | |
| 6,713,614 | B2 | 3/2004 | Carlini et al. | |
| 6,726,755 | B2 | 4/2004 | Titterington et al. | |
| 6,755,902 | B2 | 6/2004 | Banning et al. | |
| 6,821,327 | B2 | 11/2004 | Jaeger et al. | |
| 6,958,406 | B2 | 10/2005 | Banning et al. | |
| 7,053,227 | B2 | 5/2006 | Jaeger et al. | |
| 7,084,190 | B2 | 8/2006 | Everhardus et al. | |
| 7,271,284 | B2 | 9/2007 | Toma et al. | |
| 7,381,831 | B1 | 6/2008 | Banning et al. | |
| 7,427,323 | B1 | 9/2008 | Birau et al. | |
| 2011/0059233 | A1 | 3/2011 | Liu et al. | |
| 2012/0274698 | A1 * | 11/2012 | Morimitsu et al. | 347/20 |
| 2012/0274713 | A1 * | 11/2012 | Odell et al. | 347/99 |

OTHER PUBLICATIONS

Rina Carlini, et al., U.S. Appl. No. 13/095,221, filed Apr. 27, 2011, "Substituted Oxazoline Compounds or Substituted Oxazoline Derivaties," not yet published, 88 pages.

Kentaro Morimitsu, et al., U.S. Appl. No. 13/095,795, filed Apr. 27, 2011, "Solid Ink Compositions Comprising Amorphous Esters of Citric Acid," not yet published, 28 pages.

Peter G. Odell, et al., U.S. Appl. No. 13/095,043, filed Apr. 27, 2011, "Solventless Reaction Process," not yet published, 67 pages.

Naveen Chopra, et al., U.S. Appl. No. 13/095,555, filed Apr. 27, 2011, "Phase Change Inks and Methods of Making the Same," not yet published, 37 pages.

Jennifer L. Belelie, et al., U.S. Appl. No. 13/095,591, filed Apr. 27, 2011, "Phase Change Ink Components and Methods of Making the Same," not yet published, 31 pages.

Kentaro Morimitsu, et al., U.S. Appl. No. 13/095,784, filed Apr. 27, 2011, "Solid Ink Compositions Comprising Amorphous Esters of Tartaric Acid," not yet published, 31 pages.

Kentaro Morimitsu, et al., U.S. Appl. No. 13/095,715, filed Apr. 27, 2011, "Solid Ink Compositions Comprising Crystalline Esters of Tartaric Acid," not yet published, 29 pages.

Kentaro Morimitsu, et al., U.S. Appl. No. 13/095,770, filed Apr. 27, 2011, "Phase Change Inks and Methods of Making the Same," not yet published, 34 pages.

Jennifer L. Belelie, et al., U.S. Appl. No. 13/095,681, filed Apr. 27, 2011, "Solid Ink Compositions Comprising Crystalline-Amorphous Mixtures," not yet published, 31 pages.

Jennifer L. Belelie, et al., U.S. Appl. No. 13/095,636, filed Apr. 27, 2011, "Solid Ink Compositions Comprising Crystalline-Amorphous Mixtures," not yet published, 24 pages.

Kentaro Morimitsu, et al., U.S. Appl. No. 13/095,028, filed Apr. 27, 2011, "Phase Change Ink," not yet published, 39 pages.

Thomas Edward Enright, et al., U.S. Appl. No. 13/095,015, filed Apr. 27, 2011, "Solventless Reaction Process," not yet published, 34 pages.

Marcel Slot, "Oce Printhead and CrystalPoint™ Technology,", 16$^{th}$ Annual European Inkjet Conference, Nov. 13, 2008, 49 pages.

* cited by examiner

PRINT PROCESS FOR PHASE SEPARATION INK

RELATED APPLICATIONS

Commonly assigned U.S. patent application Ser. No. 13/095,174, entitled "Next-Generation Solid Inks From Novel Oxazoline Components, Developed for Robust Direct-to-Paper Printing", filed concurrently herewith, is hereby incorporated by reference herein in its entirety.

Commonly assigned U.S. patent application Ser. No. 13/095,221, entitled "Oxazoline Derivatives: Novel Components for a Next-Generation Robust Solid Ink", filed concurrently herewith, is hereby incorporated by reference herein in its entirety.

Commonly assigned U.S. patent application Ser. No. 13/095,795, entitled "Solid Ink Compositions Comprising Amorphous Esters of Citric Acid", filed concurrently herewith, is hereby incorporated by reference herein in its entirety.

Commonly assigned U.S. patent application Ser. No. 13/095,555, entitled "Phase Change Inks and Methods of Making the Same", filed concurrently herewith, is hereby incorporated by reference herein in its entirety.

Commonly assigned U.S. patent application Ser. No. 13/095,591, entitled "Phase Change Ink Components and Methods of Making the Same", filed concurrently herewith, is hereby incorporated by reference herein in its entirety.

Commonly assigned U.S. patent application Ser. No. 13/095,784, entitled "Solid Ink Compositions Comprising Amorphous Esters of Tartaric Acid", filed concurrently herewith, is hereby incorporated by reference herein in its entirety.

Commonly assigned U.S. patent application Ser. No. 13/095,715, entitled "Solid Ink Compositions Comprising Crystalline Esters of Tartaric Acid", filed concurrently herewith, is hereby incorporated by reference herein in its entirety.

Commonly assigned U.S. patent application Ser. No. 13/095,770, entitled "Phase Change Inks and Methods of Making the Same", filed concurrently herewith, is hereby incorporated by reference herein in its entirety.

Commonly assigned U.S. patent application Ser. No. 13/095,681, entitled "Solid Ink Compositions Comprising Crystalline-Amorphous Mixtures", filed concurrently herewith, is hereby incorporated by reference herein in its entirety.

Commonly assigned U.S. patent application Ser. No. 13/095,636, entitled "Solid Ink Compositions Comprising Crystalline-Amorphous Mixtures", filed concurrently herewith, is hereby incorporated by reference herein in its entirety.

Commonly assigned U.S. patent application Ser. No. 13/095,015, entitled "Solventless Reaction Process", filed concurrently herewith, is hereby incorporated by reference herein in its entirety.

BACKGROUND

Disclosed herein is a process comprising disposing at least one phase separation ink in an imagewise fashion onto a final image receiving substrate to form an ink image, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; wherein the amorphous phase of the at least one phase separation ink substantially penetrates into the final image receiving substrate; and wherein the crystalline phase of the at least one phase separation ink substantially remains on the surface of the final image receiving substrate; applying pressure to the ink image on the final image receiving substrate; and allowing the ink to complete crystallization.

Ink jetting devices are known in the art, and thus extensive description of such devices is not required herein. As described in U.S. Pat. No. 6,547,380, which is hereby incorporated by reference herein in its entirety, ink jet printing systems generally are of two types: continuous stream and drop-on-demand. In continuous stream ink jet systems, ink is emitted in a continuous stream under pressure through at least one orifice or nozzle. The stream is perturbed, causing it to break up into droplets at a fixed distance from the orifice. At the break-up point, the droplets are charged in accordance with digital data signals and passed through an electrostatic field that adjusts the trajectory of each droplet in order to direct it to a gutter for recirculation or a specific location on a recording medium. In drop-on-demand systems, a droplet is expelled from an orifice directly to a position on a recording medium in accordance with digital data signals. A droplet is not formed or expelled unless it is to be placed on the recording medium.

There are at least three types of drop-on-demand ink jet systems. One type of drop-on-demand system is a piezoelectric device that has as its major components an ink filled channel or passageway having a nozzle on one end and a piezoelectric transducer near the other end to produce pressure pulses. Another type of drop-on-demand system is known as acoustic ink printing wherein an acoustic beam exerts a radiation pressure against objects upon which it impinges. Thus, when an acoustic beam impinges on a free surface such as at the liquid/air interface of a pool of liquid from beneath, the radiation pressure which it exerts against the surface of the pool may reach a sufficiently high level to release individual droplets of liquid from the pool, despite the restraining force of surface tension. Focusing the beam on or near the surface of the pool intensifies the radiation pressure it exerts for a given amount of input power. Still another type of drop-on-demand system is known as thermal ink jet, or bubble jet, and produces high velocity droplets. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink vehicle (usually water) in the immediate vicinity to vaporize almost instantaneously and create a bubble. The ink at the orifice is forced out as a propelled droplet as the bubble expands.

In a typical design of a piezoelectric ink jet device utilizing phase change or solid inks printing directly on a substrate or on an intermediate transfer member, such as the one described in U.S. Pat. No. 5,372,852, which is hereby incorporated by reference herein in its entirety, the image is applied by jetting appropriately colored inks during four to eighteen rotations (incremental movements) of a substrate (an image receiving member or intermediate transfer member) with respect to the ink jetting head, i.e., there is a small translation of the print head with respect to the substrate in between each rotation. This approach simplifies the print head design, and the small movements ensure good droplet registration. At the jet operating temperature, droplets of liquid ink are ejected from the printing device and, when the ink droplets contact the surface of the recording substrate, either directly or via an intermediate heated transfer belt or drum, they quickly solidify to form a predetermined pattern of solidified ink drops.

Thermal ink jet processes are well known and are described, for example, in U.S. Pat. Nos. 4,601,777, 4,251,824, 4,410,899, 4,412,224 and 4,532,530, the disclosures of each of which are hereby totally incorporated herein.

As noted, ink jet printing processes may employ inks that are solid at room temperature and liquid at elevated temperatures. Such inks may be referred to as hot melt inks or phase change inks. For example, U.S. Pat. No. 4,490,731, which is hereby incorporated by reference herein in its entirety, discloses an apparatus for dispensing solid ink for printing on a substrate such as paper. In thermal ink jet printing processes employing hot melt inks, the solid ink is melted by the heater in the printing apparatus and utilized (i.e., jetted) as a liquid in a manner similar to that of conventional thermal ink jet printing. Upon contact with the printing substrate, the molten ink solidifies rapidly, enabling the colorant to substantially remain on the surface of the substrate instead of being carried into the substrate (for example, paper) by capillary action, thereby enabling higher print density than is generally obtained with liquid inks. Advantages of a phase change ink in ink jet printing are thus elimination of potential spillage of the ink during handling, a wide range of print density and quality, minimal paper cockle or distortion, and enablement of indefinite periods of nonprinting without the danger of nozzle clogging, even without capping the nozzles.

Solid inks for piezoelectric ink jet printing have been designed to successfully print in a transfix mode wherein the ink is jetted onto an intermediate transfer drum. In the transfix printing process, the ink cools from the jetting temperature (broadly, from about 75° C. and to no higher than about 180° C., and typically from about 110° C. to about 140° C.) to the drum temperature (typically from about 50° C. to about 60° C.), and, subsequently, as a substantially solid phase, the ink is pressed into a paper substrate. Such a process provides a number of advantages including vivid images, economy of jet use, and substrate latitude among porous papers. However, such ink designs can present problems when applied to coated papers. In general, the ink and the print process can fail to provide sufficient image durability in response to paper handling stresses such as scratch, fold and rub stresses. Moreover, key elements of the ink design that provide good transfix behavior may not be required or desired in a direct to paper architecture.

Currently available phase change or solid ink printing processes are suitable for their intended purposes. However, a need remains for a printing process providing improved properties including improved adherence of image to paper, improved image permanence, improved robustness against mechanical stresses, and improved image characteristics including surface gloss level. Further, a need remains for a direct to paper printing process for phase separation inks.

The appropriate components and process aspects of the each of the foregoing U.S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a process comprising disposing at least one phase separation ink in an imagewise fashion onto a final image receiving substrate to form an ink image, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; wherein the amorphous phase of the at least one phase separation ink substantially penetrates into the final image receiving substrate; and wherein the crystalline phase of the at least one phase separation ink substantially remains on the surface of the final image receiving substrate; applying pressure to the ink image on the final image receiving substrate; and allowing the ink to complete crystallization.

Also described is a process which comprises (1) incorporating into an ink jet printing apparatus at least one phase separation ink; (2) heating the at least one phase separation ink to a first temperature at which the at least one phase separation ink is in a molten, unseparated state; (3) causing droplets of the at least one phase separation ink to be ejected in an imagewise pattern onto an image receiving substrate, wherein the image receiving substrate is an intermediate transfer member or a final image receiving substrate; (4) cooling the ink image to a second temperature sufficient to initiate crystallization of at least one component of the at least one phase separation ink, wherein the at least one phase separation ink comprises a crystalline phase and an amorphous phase; (5) optionally transferring the ink image from an intermediate transfer member to a final image receiving substrate; wherein the amorphous phase of the at least one phase separation ink substantially penetrates into the final image receiving substrate; and wherein the crystalline phase of the at least one phase separation ink substantially remains on the surface of the final image receiving substrate; (6) applying pressure to the ink image on the final image receiving substrate; and (7) allowing the ink to complete crystallization.

DETAILED DESCRIPTION

Figure 1:
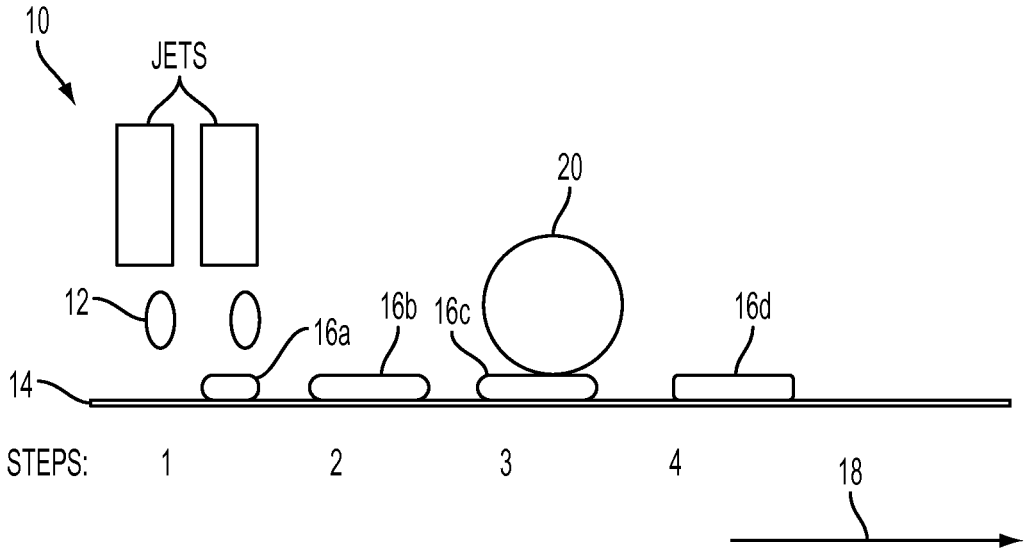
FIG. 1 is an illustration of a print process in accordance with the present disclosure.

A print process for phase separation ink is described comprising disposing at least one phase separation ink in an imagewise fashion onto an image receiving substrate, in embodiments, onto an intermediate transfer member or directly onto a final image receiving substrate, to form an ink image, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; optionally, transferring the ink image to a final image receiving substrate, if required, applying pressure to the ink image on the final image receiving substrate; and allowing the ink to complete crystallization. In embodiments, the process comprises disposing at least one phase separation ink in an imagewise fashion onto a final image receiving substrate to form an ink image, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; wherein the amorphous phase of the at least one phase separation ink substantially penetrates into the final image receiving substrate; and wherein the crystalline phase of the at least one phase separation ink substantially remains on the surface of the final image receiving substrate; applying pressure to the ink image on the final image receiving substrate; and allowing the ink to complete crystallization.

The process includes employing an ink that can comprise a single phase at jetting temperature and that, upon cooling, can comprise two phases wherein one phase is crystalline and one phase is amorphous, wherein the crystalline phase and has a substantially lower mobility than the separate amorphous phase, and wherein the amorphous phase can penetrate into the image receiving substrate, in embodiments within a top coat layer of a coated paper substrate, while the crystalline phase remains substantially or completely on the top layer without penetration.

The present process can be used for any suitable or desired printing application. In embodiment, the process is a direct printing process wherein one or more phase separation inks are disposed directly onto a final image receiving substrate. In embodiments, the final image receiving substrate is paper. In a direct to paper (DTP) ink jet printing architecture, the ink impacts the paper at essentially the same temperature as the jetting temperature (wherein jetting temperature is typically from about 100° C. to about 140° C.). As the ink cools from the jetting temperature, certain types of ink can phase separate wherein one ink component rapidly crystallizes, while another ink component is in an amorphous state. The amorphous phase continues to penetrate into the paper coating and may carry much of the colorant with it. In this process, the upper layer of crystalline material can act as a less color intensive protective coating that increase resistance of the image to mechanical damage.

The print process herein enables (1) the "molten" state of a single phase separation ink or the "molten" state of two or more inks which become blended color inks in the jetting zone, and (2) the crystallization state of the ink or inks in the spreading zone. The molten and crystallization phases enable print robustness on coated media applications as well as other print quality attributes like uniformity and gloss.

Turning to FIG. 1, a representation of a print process for printing phase separation inks in accordance with the present disclosure is shown. Print process 10 includes disposing at least one phase separation ink in an imagewise fashion onto a final image receiving substrate 14 to form an ink image 16*a*.

Although not limited to any particular order, the process can be described in terms of Steps 1, 2, 3, and 4, as shown in FIG. 1. In embodiments, the process may include Step 1 comprising jetting one or more phase separation inks from an ink jet print head onto a final ink receiving substrate, in embodiments, paper, in specific embodiments, a coated paper. The temperature of the final image receiving substrate can be higher than the crystallization temperature of the at least one crystalline or crystallizable component in the phase separation ink. Hence, the phase separation ink is in a molten state and is not phase separated in the jetting zone. In embodiments, disposing comprises disposing two or more phase separation inks, optionally of two or more different colors. In other embodiments, disposing comprises ink jetting at least one phase separation ink; and optionally, wherein disposing comprises ink jetting two or more phase separation inks, optionally of two or more different colors. When two or more phase separation inks are disposed, or jetted, blending of inks occurs, such as in the jetting zone.

Disposing the at least one phase separation ink can be at any suitable or desired temperature provided that the ink is in a molten, unseparated state. In embodiments, the at least one phase separation ink can be disposed or jetted at a temperature of from about 75 to about 180° C., from about 90 to about 150° C., from about 95° C. to about 140° C., or from about 100° C. to about 140° C.

In Step 2, the process continues along a print process direction indicated by arrow 18 with the movement of the ink image 16*a* out of the jetting zone. As the ink image leaves the jetting zone, ink image now designated as 16*b*, the ink or inks start to phase separate.

In Step 3, ink image 16*b* continues into a spreading zone. The ink image can be cooled to a second temperature sufficient to initiate or accelerate crystallization of the least one crystalline or crystallizable component of the at least one phase separation ink wherein at the second temperature the at least one phase separation ink comprises a crystalline phase and an amorphous phase. Cooling can be applied first to promote the phase separation of the ink. Cooling can comprise any suitable or desired cooling method. In embodiments, cooling can comprise air cooling, conduction cooling, fluid evaporation cooling, or a combination thereof.

Cooling can be to any suitable or desired temperature provided that the temperature is sufficient to initiate crystallization of the least one crystalline or crystallizable component of the at least one phase separation ink. In embodiments, cooling comprises cooling to a second temperature of from about 0 to about 100° C., from about 20 to about 80° C., or from about 25° C. to about 60° C.

Referring to Step 3, in embodiments, cooling can be first applied to the semi-crystallized inks of ink image 16*c* in the spreading zone to improve or increase the crystallization rates.

After a desired amount of ink separation, which can be determined by any suitable or desired method, such as by measuring temperature and time, pressure can be applied to ink image 16*c*, such as with integrated spreader roller 20. Pressure can be applied to spread the ink and create a desired surface gloss level on the ink image.

Applying pressure can comprise any suitable or desired method to spread the ink on the final image receiving substrate. Applying pressure can further comprise applying any suitable or desired amount of pressure for any suitable or desired amount of time. In embodiments, applying pressure comprises applying pressure of from about 3 to about 5,000 pounds per square inch, from about 100 to about 2,500 pounds per square inch, or from about 500 to about 1,200 pounds per square inch for a period of from about 1 to about 1,000 milliseconds, or from about 3 to about 100 milliseconds, or from about 5 to about 50 milliseconds. In specific embodiments, applying pressure can comprise applying a high pressure of about 100 to about 1,000 pounds per square inch for a period of from about 1 millisecond to about 10 milliseconds.

In embodiments, applying pressure can comprises applying pressure in a manner sufficient to provide the final image with a desired surface gloss. Desired image surface gloss can be any suitable or desired gloss measured by any suitable or desired method. In embodiments, applying pressure comprises applying pressure to spread the ink on the final image receiving substrate in a manner sufficient to provide the final image with a surface gloss of from about 10 to about 50 Gardner 60 degree gloss units at about 60° C.

The process may further comprise employing a release agent to reduce or eliminate ink offset. Any suitable or desired release agent can be selected for the present process. Examples of suitable release agents include, but are not limited to, silicone oil, fountain solution, amine functionalized oils, and combinations thereof.

The release agent can be employed in any suitable or desired amount, such as from about 0.1 to about 50, from about 0.5 to about 20, or from about 1 to about 10 milligrams per A4 size page. In embodiments, when contacting the ink directly in the ink spreading zone, a small amount, such as from about 0.5 milligrams/per A4 size page to about 10 milligrams/per A4 size page of release agent may be used to substantially reduce or eliminate ink offset.

Following the spreader zone, the ink is allowed to fully phase separate and form a robust crystalline surface. Final ink image 16*d* adheres to the final image receiving substrate and is robust against mechanical stresses such as scratching.

In embodiments, the process comprises controlling the temperature of the final image receiving substrate to control the crystallization rate of the at least one phase separation ink. Controlling the temperature of the final image receiving substrate can be carried out by any suitable or desired method at any suitable or desired time during the process. In embodiments, the final image receiving substrate is paper and the paper temperature is adjusted to keep the inks molten on the paper in the jetting zone. In specific embodiments, the final image receiving substrate is paper and the paper temperature is adjusted to keep the inks molten on the paper in the jetting zone within a range of from about 25° C. to about 85° C. In embodiments, heating the paper can be accomplished before, during, or after disposing the ink.

In another embodiment, the process herein further comprises controlling the temperature of the final image receiving substrate in an ink disposing zone to maintain the temperature of the final image receiving substrate in the ink disposing zone at a temperature that is higher than the crystallization temperature of the at least one phase separation ink, in embodiments, higher than the crystallization temperature of the at least one crystalline or crystallizable component of the phase separation ink. Heating to a temperature that is higher than the crystallization temperature can comprise heating to any suitable or desired temperature that is higher than the crystallization temperature and will depend on the particular materials selected. In embodiments, controlling the temperature of the final image receiving substrate to maintain the final substrate at a temperature that is higher than the crystallization temperature comprises maintaining the substrate at a temperature of from about 0 to about 150° C., from about 15 to about 100° C., or from about 25° C. to about 60° C.

Controlling the temperature of the final image receiving substrate can be by any suitable or desired method, such as heating. In embodiments, controlling the temperature of the final image receiving substrate in an ink disposing zone to control the crystallization rate of the at least one phase separation ink by heating the final image receiving substrate comprises using infra-red radiation, conductive heating, carrier heating, or a combination thereof.

In embodiments, the ink jetting temperature can be raised to provide a hotter ink than required for simple ink jetting. In embodiments, the process herein comprises disposing the at least one phase separation ink at a third temperature that is higher than the first temperature wherein the third temperature is from about 60 to about 180° C., from about 80 to about 150° C., or from about 45° C. to about 125° C.

Further, the time the ink image resides at a higher temperature can be adjusted to achieve a desired amount of phase separation of multilayers of ink. In embodiments, the process herein further comprises disposing the at least one phase separation ink at a third temperature that is higher than the first temperature at which the at least one phase separation ink is in a molten, unseparated state; and controlling the time that that ink mage resides on the final image receiving substrate at the third temperature to achieve a desired amount of phase separation of multilayers of phase separation ink.

Any suitable or desired phase separation ink can be used for the present process. In embodiments, the phase separation ink comprises an ink that is in a molten, unseparated state, that is, a melted, liquid, single phase, at a first temperature corresponding to a disposing or jetting temperature, and that is in a multiple phase state at a second temperature, wherein the second temperature is sufficient to initiate crystallization of at least one component of the phase separation ink, and wherein at the second temperature the phase separation ink comprises a crystalline phase and an amorphous phase. That is, the phase separation ink can comprise at least one component that crystallizes at a second temperature and at least one component that is amorphous at the second temperature.

As used herein, a crystalline component or crystallizable component means a solid material, whose constituent atoms, molecules, or ions are arranged in an orderly repeating pattern extending in all three spatial dimensions.

As used herein, amorphous component means a solid material which does not exhibit crystalline structure. That is, while there may be local ordering of the atoms or molecules, there is no long-term ordering thereof.

The crystalline component selected for embodiments herein can be any suitable or desired crystalline component having the desired characteristics and which is miscible with the selected amorphous component. The crystalline component can have any suitable or desired melting temperature. In embodiments, the crystalline component herein has a melt temperature of from about 65 to about 150° C., from about 66 to about 145° C., or from about 67° C. to about 140° C. In a specific embodiment, the at least one crystalline component herein has a melting temperature less than about 150° C.

The crystalline component can have any suitable or desired crystallization temperature. In embodiments, the crystalline component has a crystallization temperature of from about 60 to about 140° C., from about 65 to about 125° C., or from about 66° C. to about 120° C., as determined by Differential Scanning calorimetry at a rate of 10° C./minute. In a specific embodiment, the at least one crystalline component herein has a crystallization temperature of greater than about 65° C. to less than about 140° C.

Examples of suitable crystalline or crystallizable components are illustrated in Table 1.

TABLE 1

| Compound | Structure | $T_{melt}$ (° C.)* | $T_{crys}$ (° C.)* | η @ 140° C. (cps)** | η @ RT (cps)** |
|---|---|---|---|---|---|
| 1 | 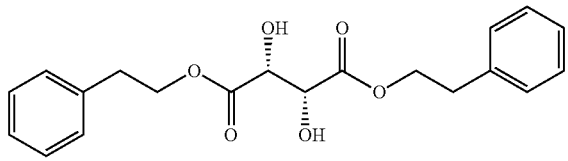 | 110 | 83 | 4.7 | >$10^6$ |
| 2 | 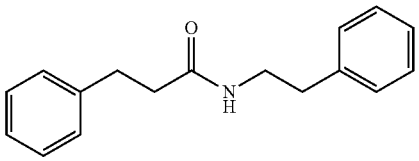 | 98 | 71 | 2.9 | >$10^6$ |
| 3 | 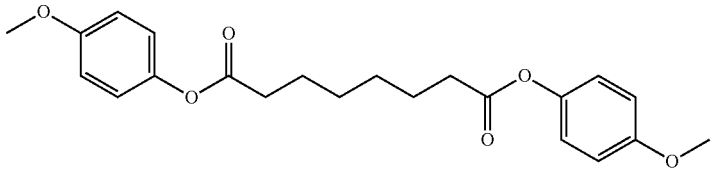 | 119 | 80 | 3.3 | >$10^6$ |
| 4 | 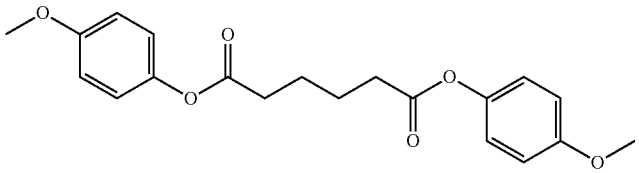 | 125 | 75 | 3.0 | >$10^6$ |
| Target | | <140° C. | >65° C. | <10 cps | >$10^6$ cps |

*The samples were measured on a Q1000 Differential Scanning Calorimeter (TA Instruments) at a rate of 10° C./minute from −50° C. to 200° C. to −50° C.; midpoint values are quoted.

**The samples were measured on a RFS3 controlled strain Rheometer (TA instruments) equipped with a Peltier heating plate and using a 25 millimeter parallel plate. The method used was a temperature sweep from high to low temperatures, in temperature decrements of 5° C., a soak (equilibration) time of 120 seconds between each temperature and at a constant frequency of 1 Hz.

In embodiments, the crystalline component can be crystalline aromatic monoesters described in commonly assigned, co-pending U.S. patent application Ser. No. 13/095,028, which is hereby incorporated by reference herein in its entirety, crystalline diesters described in commonly assigned, co-pending U.S. patent application Ser. No. 13/095,555, which is hereby incorporated by reference herein in its entirety, crystalline esters of tartaric acid as described in co-pending, commonly assigned U.S. patent application Ser. No. 13/095,715, which is hereby incorporated by reference herein in its entirety, and crystalline aromatic amides described in commonly assigned, co-pending U.S. patent application Ser. No. 13/095,770, which is hereby incorporated by reference herein in its entirety.

The crystalline component can be prepared by any suitable or desired method. For example, the crystalline component can be prepared by an esterification reaction between a compound having a hydroxyl group and a compound having a carboxylic acid group or an acid chloride group. Crystalline components are also commercially available, such as from TCI America.

The amorphous components provide tackiness and impart robustness to the printed ink. In the present embodiments, desirable amorphous materials have relatively low viscosity (<102 cps, or from about 1 to about 100 cps, or from about 5 to about 95 cps) at about 140° C., but very high viscosity (>106 cps) at room temperature. The low viscosity at 140° C. provides wide formulation latitude while the high viscosity at room temperature imparts robustness. The amorphous materials have Tgs (glass transition temperatures) but do not exhibit crystallization and melting peaks by DSC (10° C./min from −50 to 200 to −50° C.). The Tg values are typically from about 10 to about 50° C., or from about 10 to about 40° C., or from about 10 to about 35° C., to impart the desired toughness and flexibility to the inks. The selected amorphous materials have low molecular weights, such as less than 1000 g/mol, or from about 100 to about 1000 g/mol, or from about 200 to about 1000 g/mol, or from about 300 to about 1000 g/mol. Higher molecular weight amorphous materials such as polymers become viscous and sticky liquids at high temperatures, but have viscosities that are too high to be jettable with piezoelectric printheads at desirable temperatures. Examples of suitable amorphous materials are illustrated in Table 2.

TABLE 2

| Compound | Structure | Tg (° C.)* | η @ 140° C. (cps)** | MW (g/mol) |
|---|---|---|---|---|
| 5 | 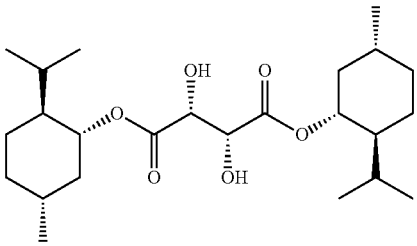 | 19 | 10 | 426.59 |
| 6 | 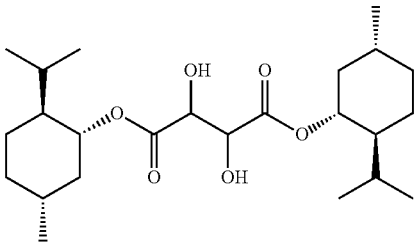 | 18 | 10 | 426.59 |
| 7 | 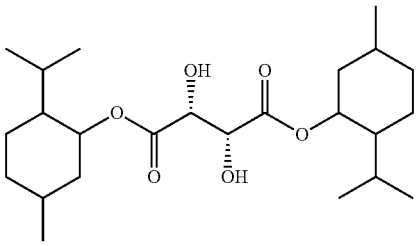 | 13 | 10 | 426.59 |
| 8 | 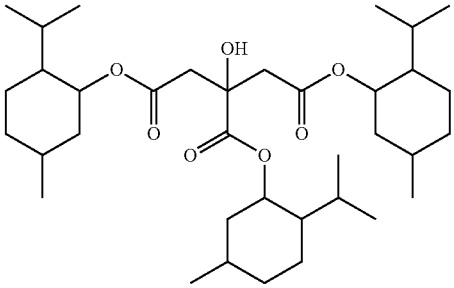 | 11 | 27 | 606.87 |
| Target | | 10-50° C. | <100 cps | <1000 g/mol |

*The samples were measured on a Q1000 Differential Scanning Calorimeter (TA Instruments) at a rate of 10° C./min from −50° C. to 200° C. to −50° C.; midpoint values are quoted.
**The samples were measured on a RFS3 controlled strain Rheometer (TA instruments) equipped with a Peltier heating plate and using a 25 millimeter parallel plate. The method used was a temperature sweep from high to low temperatures, in temperature decrements of 5° C., a soak (equilibration) time of 120 seconds between each temperature and at a constant frequency of 1 Hz.

In embodiments, the amorphous component can be selected from those described in commonly assigned, co-pending U.S. patent application Ser. No. 13/095,015, which is hereby incorporated by reference herein in its entirety, commonly assigned, co-pending U.S. patent application Ser. No. 13/095,795, which is hereby incorporated by reference herein in its entirety, and commonly assigned, co-pending U.S. patent application Ser. No. 13/095,784, which is hereby incorporated by reference herein in its entirety.

The amorphous component can be prepared by any suitable or desired method. In embodiments, the amorphous component can be prepared as described in commonly assigned, co-pending U.S. patent application Ser. No. 13/095,015, incorporated by reference hereinabove.

The crystalline component can be present in the phase change ink at any suitable or desired amount. In embodiments, the crystalline component is provided at from about 60 to about 95, or from about 65 to about 95, or from about 70 to about 90 weight percent, based upon the total combined weight of the crystalline and amorphous components.

The amorphous component can be present in the phase change ink at any suitable or desired amount. In embodiments, the amorphous component is provided at from about 5 to about 40, or from about 5 to about 35, or from about 10 to about 30 weight percent, based upon the total combined weight of the crystalline and amorphous components.

In embodiments, the ratio of crystalline component to amorphous component is from about 60:40 to about 95:5 percent by weight, based upon the total combined weight of the crystalline and amorphous components. In more specific embodiments, the weight ratio of the crystalline component to amorphous component is from about 65:35 to about 95:5, or from about 70:30 to about 90:10 percent by weight, based upon the total combined weight of the crystalline and amorphous components.

The phase change inks can further contain a colorant compound. This optional colorant can be present in the ink in any desired or effective amount to obtain the desired color or hue, in embodiments from about 0.1 percent to about 50 percent by weight of the ink. Any desired or effective colorant can be employed, including dyes, pigments, mixtures thereof, and the like, provided that the colorant can be dissolved or dispersed in the ink vehicle. The phase change carrier compositions can be used in combination with conventional phase change ink colorant materials, such as Color Index (C.I.) Solvent Dyes, Disperse Dyes, modified Acid and Direct Dyes, Basic Dyes, Sulphur Dyes, Vat Dyes, and the like.

Examples of suitable dyes include Neozapon® Red 492 (BASF); Orasol® Red G (Pylam Products); Direct Brilliant Pink B (Oriental Giant Dyes); Direct Red 3BL (Classic Dyestuffs); Supranol® Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); Cartasol® Brilliant Yellow 4GF (Clariant); Cibanone Yellow 2G (Classic Dyestuffs); Orasol® Black RLI (BASF); Orasol® Black CN (Pylam Products); Savinyl Black RLSN(Clariant); Pyrazol Black BG (Clariant); Morfast® Black 101 (Rohm & Haas); Diaazol Black RN (ICI); Thermoplast® Blue 670 (BASF); Orasol® Blue GN (Pylam Products); Savinyl Blue GLS (Clariant); Luxol Fast Blue MBSN (Pylam Products); Sevron Blue 5GMF (Classic Dyestuffs); Basacid® Blue 750 (BASF); Keyplast Blue (Keystone Aniline Corporation); Neozapon® Black X51 (BASF); Classic Solvent Black 7 (Classic Dyestuffs); Sudan Blue 670 (C.I. 61554) (BASF); Sudan Yellow 146 (C.I. 12700) (BASF); Sudan Red 462 (C.I. 26050) (BASF); C.I. Disperse Yellow 238; Neptune Red Base NB543 (BASF, C.I. Solvent Red 49); Neopen® Blue FF-4012 (BASF); Fastol® Black BR (C.I. Solvent Black 35) (Chemische Fabriek Triade BV); Morton Morplas Magenta 36 (C.I. Solvent Red 172); metal phthalocyanine colorants, such as those disclosed in U.S. Pat. No. 6,221,137, the disclosure of which is totally incorporated herein by reference, and the like. Polymeric dyes can also be used, such as those disclosed in, for example, U.S. Pat. Nos. 5,621,022 and 5,231,135, the disclosures of each of which are hereby incorporated by reference herein in their entireties, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactint® Orange X-38, uncut Reactint® Blue X-17, Solvent Yellow 162, Acid Red 52, Solvent Blue 44, and uncut Reactint® Violet X-80.

Pigments are also suitable colorants for the phase change inks. Examples of suitable pigments include PALIOGEN® Violet 5100 (BASF); PALIOGEN® Violet 5890 (BASF); HELIOGEN® Green L8730 (BASF); LITHOL® Scarlet D3700 (BASF); SUNFAST® Blue 15:4 (Sun Chemical); Hostaperm® Blue B2G-D (Clariant); Hostaperm® Blue B4G (Clariant); Permanent Red P-F7RK; Hostaperm® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA® PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); Sudan Blue OS (BASF); NEOPEN® Blue FF4012 (BASF); PV Fast Blue B2GO1 (Clariant); IRGALITE® Blue GLO (BASF); PALIOGEN® Blue 6470 (BASF); Sudan Orange G (Aldrich); Sudan Orange 220 (BASF); PALIOGEN® Orange 3040 (BASF); PALIOGEN® Yellow 152, 1560 (BASF); LITHOL® Fast Yellow 0991 K (BASF); PALIOTOL® Yellow 1840 (BASF); NOVOPERM® Yellow FGL (Clariant); Ink Jet Yellow 4G VP2532 (Clariant); Toner Yellow HG (Clariant); Lumogen® Yellow D0790 (BASF); Suco-Yellow L1250 (BASF); Suco-Yellow D1355 (BASF); Suco Fast Yellow D1355, D1351 (BASF); HOSTAPERM® Pink E 02 (Clariant); Hansa Brilliant Yellow 5GX03 (Clariant); Permanent Yellow GRL 02 (Clariant); Permanent Rubine L6B 05 (Clariant); FANAL® Pink D4830 (BASF); CINQUASIA® Magenta (DU PONT); PALIOGEN® Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

Pigment dispersions in the ink base may be stabilized by synergists and dispersants. Generally, suitable pigments may be organic materials or inorganic. Magnetic material-based pigments are also suitable, for example, for the fabrication of robust Magnetic Ink Character Recognition (MICR) inks. Magnetic pigments include magnetic nanoparticles, such as for example, ferromagnetic nanoparticles.

Also suitable are the colorants disclosed in U.S. Pat. Nos. 6,472,523, 6,726,755, 6,476,219, 6,576,747, 6,713,614, 6,663,703, 6,755,902, 6,590,082, 6,696,552, 6,576,748, 6,646,111, 6,673,139, 6,958,406, 6,821,327, 7,053,227, 7,381,831 and 7,427,323, the disclosures of each of which are hereby totally incorporated by reference herein in their entireties.

The colorant may be present in the phase change ink in any desired or effective amount to obtain the desired color or hue such as, for example, from about 0.1 to about 50 percent by weight of the ink, about 0.2 to about 20 percent by weight of the ink, or about 0.5 to about 10 percent by weight of the ink.

The inks of the present disclosure can also optionally contain an antioxidant. The optional antioxidants of the ink compositions protect the images from oxidation and also protect the ink components from oxidation during the heating portion of the ink preparation process. Specific examples of suitable antioxidants include NAUGUARD® 524, NAUGUARD® 76, NAUGUARD® 445, and NAUGUARD® 512, commercially available from Uniroyal Chemical Company, Oxford, Conn., IRGANOX® 1010 (Ciba Geigy), N,N'-hexamethylene bis(3,5-di-tert-butyl-4-hydroxy hydrocinnamamide) (IRGANOX® 1098, BASF), 2,2-bis(4-(2-(3,5-di-tert-butyl-4-hydroxyhydrocinnamoyloxy)ethoxyphenyl)propane (TOPANOL-205®, available from Vertellus), tris(4-tert-butyl-3-hydroxy-2,6-dimethyl benzyl)isocyanurate (Aldrich), 2,2'-ethylidene bis(4,6-di-tert-butylphenyl)fluoro phosphonite (ETHANOX-398®, Albermarle Corporation), tetrakis (2,4-di-tert-butylphenyl)-4,4'-biphenyl diphosphonite (ALDRICH 46), pentaerythritol tetrastearate (TCI America), tributylammonium hypophosphite (Aldrich), 2,6-di-tert-butyl-4-methoxyphenol (Aldrich), 2,4-di-tert-butyl-6-(4-methoxybenzyl)phenol (Aldrich), 4-bromo-2,6-dimethylphenol (Aldrich), 4-bromo-3,5-didimethylphenol (Aldrich), 4-bromo-2-nitrophenol (Aldrich), 4-(diethyl aminomethyl)-2,5-dimethylphenol (Aldrich), 3-dimethylaminophenol (Aldrich), 2-amino-4-tert-amylphenol (Aldrich), 2,6-bis(hydroxymethyl)-p-cresol (Aldrich), 2,2'-methylenediphenol (Aldrich), 5-(diethylamino)-2-nitrosophenol (Aldrich), 2,6-dichloro-4-fluorophenol (Aldrich), 2,6-dibromo fluoro phenol (Aldrich), α-trifluoro-o-cresol (Aldrich), 2-bromo-4-fluorophenol (Aldrich), 4-fluorophenol (Aldrich), 4-chlorophenyl-2-chloro-1,1,2-tri-fluoroethyl sulfone (Aldrich), 3,4-difluoro phenylacetic acid (Adrich), 3-fluorophenylacetic acid (Aldrich), 3,5-difluoro phenylacetic acid (Aldrich), 2-fluorophenylacetic acid (Aldrich), 2,5-bis (trifluoromethyl)benzoic acid (Aldrich), ethyl-2-(4-(4-(trifluoromethyl)phenoxy)phenoxy)propionate (Aldrich), tetrakis(2,4-di-tert-butyl phenyl)-4,4'-biphenyl diphosphonite (Aldrich), 4-tert-amyl phenol (Aldrich), 3-(2H-benzotriazol-2-yl)-4-hydroxy phenethylalcohol (Aldrich), and the like, as well as mixtures thereof. When present, the optional antioxidant is present in the ink in any desired or effective amount, such as from about 0.01 percent to about 20 percent by weight of the ink.

Other optional additives to the inks include defoamer, slip and leveling agents clarifiers, tackifiers, adhesives, plasticizers, and the like, in any suitable or desired amount such as from about 0.1 to about 50 percent by weight of the ink.

The phase change ink can be prepared by any suitable or desired method. For example, the components can be combined with stirring and heating to form the phase change ink. The phase change ink carrier materials may be combined in any suitable or desired order. For example, each of the components of the ink carrier can be mixed together, followed by heating the mixture to at least its melting point, for example from about 60° C. to about 150° C., about 80° C. to about 145° C., or about 85° C. to about 140° C., although not limited. The colorant may be added before the ink ingredients have been heated or after the ink ingredients have been heated. When pigments are the selected colorants, the molten mixture may be subjected to grinding in an attritor or ball mill apparatus or other high energy mixing equipment to affect dispersion of the pigment in the ink carrier. The heated mixture can then be stirred, such as for about 5 seconds to about 30 minutes or more, to obtain a substantially homogeneous, uniform melt, followed by cooling the ink to ambient temperature (typically from about 20° C. to about 25° C.). The inks are solid at ambient temperature.

The ink compositions herein generally have melt viscosities of from about 1 centipoise to about 14 centipoise, or from about 2 centipoise to about 13 centipoise, or from about 3 centipoise to about 12 centipoise, although the melt viscosity can be outside of these ranges, at the jetting temperature, in embodiments, jetting temperature being from about 95° C. to about 150° C., about 100° C. to about 145° C., about 100° C. to about 140° C., or no higher than about 150° C., although the jetting temperature can be outside of these ranges. In embodiments, the phase change ink herein has a viscosity at jetting temperature of from about 2 centipoise to less than about 10 centipoise, wherein jetting temperature is from about 50° C. to about 140° C. In a specific embodiment, the phase change ink herein has a viscosity of less than about 10 centipoise at jetting temperature, wherein jetting temperature is from about 50° C. to about 140° C. In another specific embodiment, the phase change ink herein has a viscosity of about 0.5 to about 10 centipoise at a jetting temperature of about 140° C.

The phase change inks herein can be employed in apparatus for direct printing ink jet processes and in indirect (offset) printing ink jet applications One embodiment of the present disclosure is directed to a process which comprises incorporating a phase separation ink into an ink jet printing apparatus, melting the ink, and causing droplets of the melted ink to be ejected in an imagewise pattern onto a recording substrate. A direct printing process is disclosed in, for example, U.S. Pat. No. 5,195,430, the disclosure of which is totally incorporated herein by reference. In embodiments, the substrate is a final recording sheet and droplets of the melted ink are ejected in an imagewise pattern directly onto the final recording sheet.

Yet another embodiment of the present disclosure is directed to a process which comprises incorporating a phase separation ink into an ink jet printing apparatus, melting the ink, causing droplets of the melted ink to be ejected in an imagewise pattern onto an intermediate transfer member, and transferring the ink in the imagewise pattern from the intermediate transfer member to a final recording substrate. In embodiments, the process can include using a belt or thin drum to transport the ink image on the intermediate transfer member through the temperatures zones necessary to induce the phase separation and then transfer and spread the ink image on a final image receiving substrate. In a specific embodiment, the intermediate transfer member is heated to a temperature above that of the final recording sheet and below that of the melted ink in the printing apparatus. In another specific embodiment, both the intermediate transfer member and the final recording sheet are heated; in this embodiment, both the intermediate transfer member and the final recording sheet are heated to a temperature below that of the melted ink in the printing apparatus; in this embodiment, the relative temperatures of the intermediate transfer member and the final recording sheet can be (1) the intermediate transfer member is heated to a temperature above that of the final recording substrate and below that of the melted ink in the printing apparatus; (2) the final recording substrate is heated to a temperature above that of the intermediate transfer member and below that of the melted ink in the printing apparatus; or (3) the intermediate transfer member and the final recording sheet are heated to approximately the same temperature. An offset or indirect printing process is also disclosed in, for example, U.S. Pat. No. 5,389,958, the disclosure of which is totally incorporated herein by reference. In one specific embodiment, the printing apparatus employs a piezoelectric printing process wherein droplets of the ink are caused to be ejected in imagewise pattern by oscillations of piezoelectric vibrating elements. In embodiments, the intermediate transfer member is heated to a temperature above that of the final recording sheet and below that of the melted ink in the printing apparatus.

Inks of the present disclosure can also be employed in other hot melt printing processes, such as hot melt acoustic ink jet printing, hot melt thermal ink jet printing, hot melt continuous stream or deflection ink jet printing, and the like. Phase change inks of the present disclosure can also be used in printing processes other than hot melt ink jet printing processes.

In embodiments, a process herein comprises (1) incorporating into an ink jet printing apparatus at least one phase separation ink; (2) heating the at least one phase separation ink to a first temperature at which the at least one phase separation ink is in a molten, unseparated state; (3) causing droplets of the at least one phase separation ink to be ejected in an imagewise pattern onto a final image receiving substrate; (4) cooling the ink image to a second temperature sufficient to initiate crystallization of at least one component of the at least one phase separation ink, wherein the at least one phase separation ink comprises a crystalline phase and an amorphous phase; wherein the amorphous phase of the at least one phase separation ink substantially penetrates into the final image receiving substrate; and wherein the crystalline phase of the at least one phase separation ink substantially remains on the surface of the final image receiving substrate; (5) applying pressure to the ink image on the final image receiving substrate; and (6) allowing the ink to complete crystallization.

In certain embodiments, the process herein comprises disposing at least one phase separation ink in an imagewise fashion onto a final image receiving substrate to form an ink image, wherein the at least one phase separation ink comprises at least one crystalline component selected from the compounds of Table 1 and at least one amorphous component selected from the compounds of Table 2, wherein disposing is at a first temperature at which the at least one phase separation ink is in a molten, unseparated state; cooling the ink image to a second temperature sufficient to initiate crystallization of at least one component of the at least one phase separation ink, wherein at the second temperature the at least one phase separation ink comprises a crystalline phase and an amorphous phase; applying pressure to the ink image on the final image receiving substrate; and allowing the ink to complete crystallization.

Any suitable substrate or recording sheet can be employed, including plain papers such as XEROX® 4200 papers, XEROX® Image Series papers, Courtland 4024 DP paper, ruled notebook paper, bond paper, coated paper, silica coated papers such as Sharp Company silica coated paper, JuJo paper, Hammermill® Laserprint Paper, and the like, glossy coated papers, such as XEROX® Digital Color Elite Gloss, Sappi Warren Papers LUSTROGLOSS®, specialty papers such as Xerox® DURAPAPER®, and the like, calcium carbonate coated paper, clay coated paper, kaolin clay coated paper, and the like, transparency materials, fabrics, textile products, plastics, polymeric films, inorganic substrates such as metals and wood, and the like. In a specific embodiment, the final image receiving substrate is coated paper. In another specific embodiment, the final image receiving substrate is clay coated paper.

In embodiments, the process herein comprises a process wherein the final image receiving substrate comprises a base layer, a top coat layer disposed over a first surface of the base layer; and, optionally, a bottom coat layer disposed over a second, opposite surface of the base layer; wherein the ink image is disposed on the top coat layer; wherein the amorphous phase of the at least one phase separation ink substantially penetrates into the top coat layer of the final image receiving substrate; and wherein the crystalline phase of the at least one phase separation ink substantially remains on the surface of the top coat layer of the final image receiving substrate.

The morphology of the ink image on paper can play a large role in determining the robustness of the image. For instance, an ink that soaks deep into the paper may approach the robustness of the paper itself as it cannot be damaged without damage to the paper itself. However, such an ink may have noticeable and objectionable image show-through on the reverse side of the paper. The present process provides partial penetration of phase separation ink into coated papers. In embodiments, this is accomplished by soaking into the thin coating at the paper surface. The coating in most papers consists of calcium carbonate and/or kaolin clay with a small amount of polymer binder. The process herein provides parameters that favor the crystallization of one ink component. In some ink formulations, a crystalline material may "super-cool" forming a glass so rapidly that the molecules lack the mobility to crystallize. The present process can comprise maintaining an intermediate temperature at which the molecules have sufficient mobility to crystallize so as to reduce or eliminate this super-cooling effect. Additionally, the amorphous phase that penetrates into the paper coating is generally chosen to have many orders of magnitude variation in viscosity between the jetting temperature and ambient temperature. In embodiments, selected print process temperatures can be selected herein to determine the degree of penetration of the amorphous phase into the paper coating. In specific embodiments, a set of time, temperature, and pressure parameters are selected to provide the desired degree of spreading of the ink image.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Example 1

52.4 grams of Compound 3 of Table 1 (above) were combined with 22.5 grams of Compound 6 of Table 2 (above) and stirred at 140° C. for 1 hour. A fine precipitate remained so the ink base was filtered with a 5 μm sieve to form a clear, dark amber solution. To this solution was added 2.3 g Orasol Blue GN (Ciba) and the full ink was stirred for an additional hour140° C. The ink was filtered easily through a 5 μm sieve.

The ink of Example 1 was printed according to the process described herein including steps equivalent steps to FIG. 1. The ink of Example 1 was loaded into a modified Xerox® 8860 printer. The ink was melted at 115° C. and jetted on to glossy paper at 55° C. The paper with jetted ink was transported to a second modified Xerox® 8860 for a spreading process. The printer applied pressure of 800 pounds per square inch at an elevated temperature of 57.5° C. on the ink image at a speed of 1 letter-size paper per second.

Figure 2:
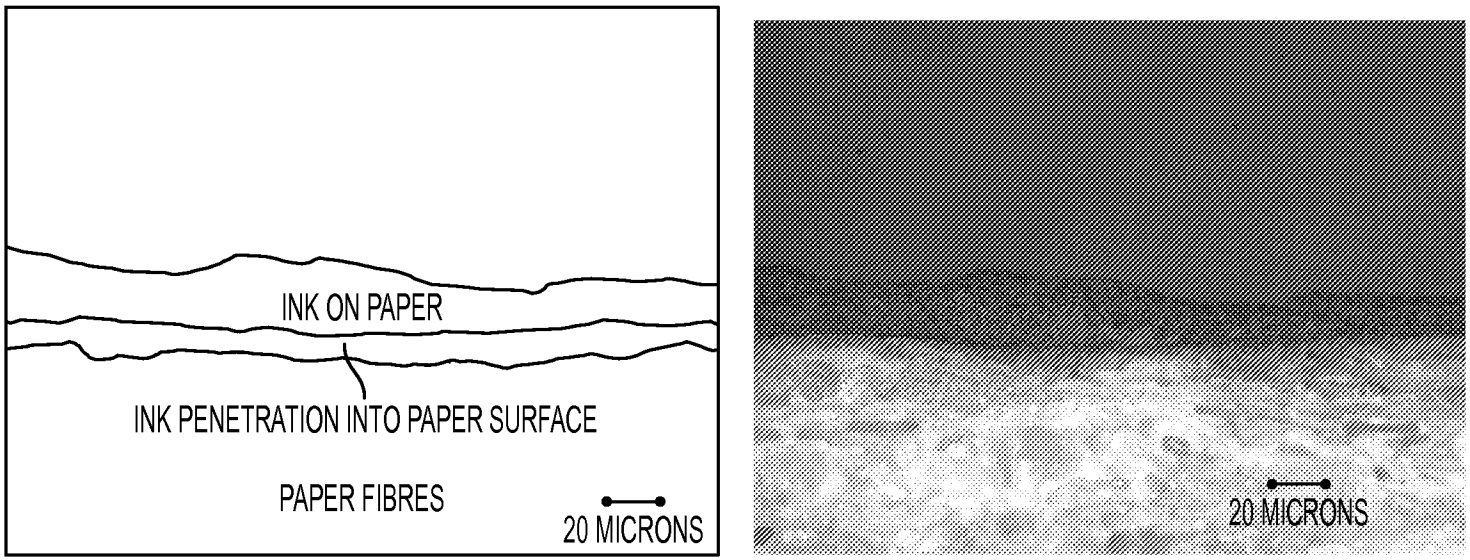
FIG. 2 is a drawing (left illustration) and a micrograph (right picture) of a printed ink printed in accordance with the present disclosure.

FIG. 2 provides a schematic illustration (left picture of FIG. 2) and a micrograph (right picture of FIG. 2) of the present print process showing the ink of Example 1 as a cross-sectional image after printing by the present process. The cross-sectional micrograph of FIG. 2, and the remaining micrographs described herein, were taken using an Axialplan optical microscope available from Carl Zeiss, Inc. The schematic illustration is intended as a guide for the eye as the micrograph on the right is examined and shows the penetration of the ink into the paper coating layer.

Figure 3:
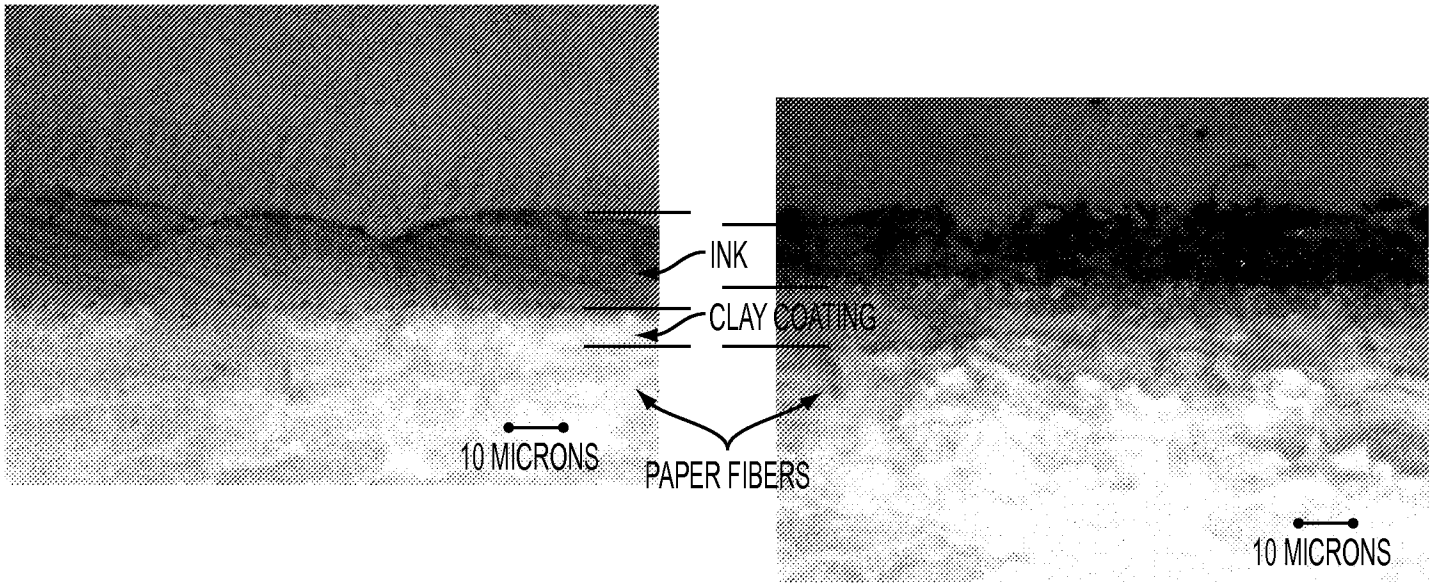
FIG. 3 is a photomicrograph showing a comparative print process (left picture) versus a print process in accordance with the present disclosure (right picture).

FIG. 3 is a photomicrograph showing a comparative print process (left picture) using a currently available ink (Xerox® Part Number 108R00749) versus a print process in accordance with the present disclosure (right picture) using the present process and an ink as described U.S. patent application Ser. No. 13/095,043, entitled "Phase Separation Ink", Examples 3a and 3b, General Preparation of Oxazoline Ink, prepared as follows.

A. Preparation of Oxazoline Crystalline Phase-Change Component.

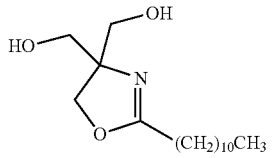

A 1 Liter Parr reactor equipped with a double turbine agitator, and distillation apparatus, was charged with dodecanoic acid (200 grams; SIGMA-ALDRICH, Milwaukee, Wis.), tris(hydroxymethyl)amino-methane (92 grams; EMD Chemicals, New Jersey), and FASCAT® 4100 as catalyst (0.45 grams; Arkema Inc). The contents were heated to 165° C. for a 2 hour period, followed by increasing the temperature to 205° C. over a 2 hour period during which time the water distillate was collected in a distillation receiver. The reactor pressure was then reduced to about 1-2 mm-Hg for one hour, followed by discharging into a container and cooled to room temperature. The product was purified by dissolving with mild heating in a mixture of ethyl acetate (2.5 parts) and hexane (10 parts), and then cooling to room temperature to crystallize the pure product as a white granular powder. The peak melting point (DSC) was determined to be 99° C. Rheological analysis of this material was measured over a temperature range of 130° C. down to 40° C. using a RFS3 Rheometrics instrument (oscillation frequency of 1 Hz, 25 millimeter parallel plate geometry, 200% applied strain). The material exhibited a melt viscosity at 130° C. of 8.2 cPs, an onset temperature of crystallization at 95° C., a peak viscosity of $4.5\times10^6$ cPs, and a peak crystallization temperature at 85° C.

B. Preparation of Amorphous Binder Resin of Oxazoline Ink.

Step I: Synthesis of Dimer Oxazoline Tetra-Alcohol precursor

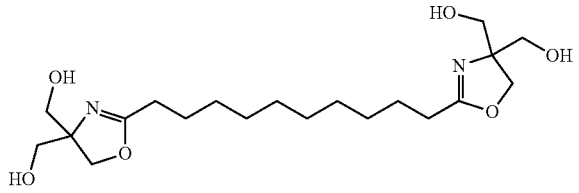

Into a 1 Liter Parr reactor equipped with a double turbine agitator, and distillation apparatus, was charged (in order): 1,12-dodecanedioic acid (291 grams; SIGMA-ALDRICH Ltd., Milwaukee, Wis.), tris-(hydroxymethyl)-aminomethane (306.9 grams; EMD chemicals, New Jersey), and FASCAT® 4100 catalyst (1.0 g, Arkema Inc.). The reaction mixture was heated to internal temperature of 165° C. for a 2 hour period, followed by increasing the temperature to 205° C. over another 2 hour period, during which time the water distillate was collected in a receiver. The reaction pressure was then reduced to approximately 1-2 mmHg for 1 hour, after which the contents were discharged into a container and cooled. The crude product yield was approximately 480 grams of a very hard, amber colored glass resin (estimated as 80% pure by 1H-NMR). The product was purified by first dissolving the crude compound in boiling methanol, which was then filtered hot to remove insoluble material, and then cooled gradually to room temperature to afford the recrystallized product. After vacuum filtration and rinsing with cold methanol, the pure product is obtained as white granular powder, with peak melting point>170° C. (by DSC).

Step II: Preparation of amorphous binder resin, a mixture of oxazoline compounds

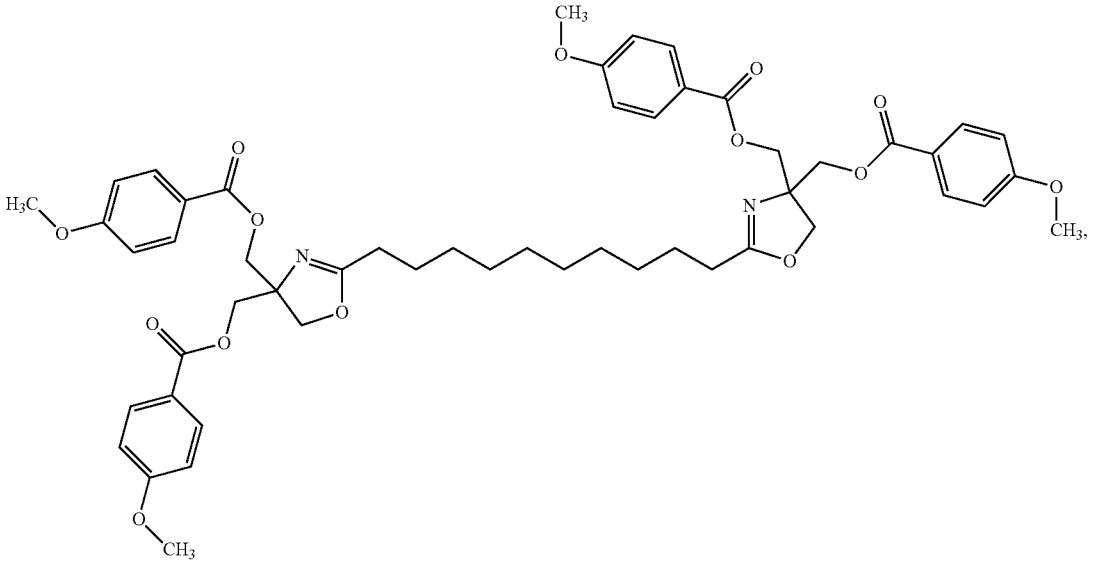

-continued

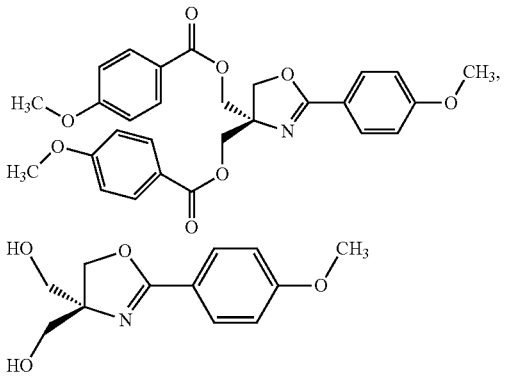

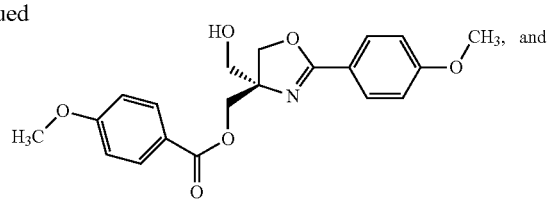

Into a 1 liter stainless steel jacketed Buchi reactor equipped with distillation condenser, 4-blade impeller, and thermocouple was charged, in order: 30.4 grams (0.075 mol) Dimer Oxazoline Tetra Alcohol of Step I, 228.2 grams (1.50 mol) 4-methoxybenzoic acid, 51.48 grams (0.425 mol) tris(hydroxymethyl)aminomethane (obtained from Aldrich, 98%), and 0.26 gram (1.2 mmol) FASCAT® 4100 catalyst. The mixture was heated up to 160° C. jacket temperature under a pressurized nitrogen atmosphere of 50 kPa without stirring. Once at temperature, the stirring was begun and the jacket temperature was gradually increased to 180° C. over 30 minutes, and then maintained for about 2 hours. Water distillate from the condensation reaction was collected over this time period (about 10 grams). The jacket temperature was then increased to 190° C. and maintained for 1 hour, which produced more water distillate. Vacuum reduced pressure of ~10 torr was applied for another 1 hour, which produced ~10 grams of water distillate. Once there was no more water distillate collected, the reaction was stopped by cooling to 130° C., and then the product was discharged. The crude yield of resin product was about 400 grams, obtained as a light amber-colored viscous resin without further purification. Rheological analysis of this material was measured over a temperature range of 130° C. down to 40° C. using a RFS3 Rheometrics instrument (oscillation frequency of 1 Hz, 25 mm parallel plate geometry, 200% applied strain). The viscosity of this material at 130° C. was measured to be about 75 cPs, and viscosity of about $1.5\times10^5$ cPs at about 50° C.

Two example formulations of Oxazoline Inks are provided in Table 3 below.

TABLE 3

| | Component | Example 3a Wt % | Example 3b Wt % |
|---|---|---|---|
| Crystalline Phase-change agent | A Oxazoline Compound | 62.80 | 63.5 |
| Amorphous Binder Resin | B Oxazoline Material | 30.00 | 30.00 |
| Viscosity modifier | (KEMAMIDE S-180 (obtained from Witco Corp., USA) | 4.00 | 3.50 |
| Antioxidant | Naugard 445 (obtained from Chemtura, USA) | 0.20 | 0.00 |
| Colorant | Orasol Blue GN dye (obtained from Ciba-Geigy, USA) | 3.00 | 3.00 |
| Ink Properties | *Viscosity @ 130° C. (cPs) | 13.6 | 11.20 |

TABLE 3-continued

| Component | Example 3a Wt % | Example 3b Wt % |
|---|---|---|
| *Viscosity @ 60° C. (cPs) | $4.6\times10^6$ | $5.4\times10^7$ |
| Onset Tcryst. (° C.) (by rheology) | 78 | 88 |
| Melt Temp (° C.) (by DSC**) | 81.5 | 89 |
| Tcryst. (° C.) (by DSC**) | 62 (small) 54 (large) | 66.5 |

*Oscillation Frequency = 1 Hz; 25 mm parallel plate geometry; gap = 0.2 mm; strain % = 200%-400%, strain independent viscosities as measured on a Rheometrics RFS3 instrument.
**DSC analysis performed on a TA Instruments Q1000 machine, measured after two heating and cooling cycles using a scan rate of 10° C./min.

Into a 500 milliliter resin kettle was charged, in the following order: amorphous oxazoline binder resin prepared according to B, above, (30 weight % of ink); molten oxazoline crystalline compound prepared according to A, above, (62-64 weight % of ink; see formulations in Table 3); Kemamide® S-180 as a viscosity modifier (commercially available from Chemtura Corporation) (3-4 weight % of ink); NAUGARD 445® as antioxidant (obtained from Chemtura, USA); and lastly a colorant (Orasol Blue GN dye, obtained from Ciba-Geigy, USA). The mixture was heated in a mantle at 130° C. internal temperature and stirred mechanically for about 2 hours using a stainless steel 4-blade 90° pitch impeller at approximately 175-250 rpm. The ink base mixture was then hot-filtered at 120° C. using a KST filtration apparatus through a 5-micron stainless steel 325×2300 mesh wire filter cloth (type 304 SS obtained from Gerard Daniel Worldwide, Hanover, USA), in order to remove particulates. The molten mixture was returned to a 500 milliliter resin kettle and heated at 130° C. internal temperature while stirring mechanically. Into this ink base was added colorant (6.0 grams of Orasol® Blue GN dye, obtained from CIBA; 3 weight % of ink) in small portions over a 0.5 hour period of time while continuing to heat. Once the colorant addition was completed, the colored ink composition was allowed to stir for addition 3-4 hrs at 130° C. while stiffing at 275 rpm, to ensure homogeneity of the ink composition. The colored ink composition was then hot-filtered once more at 120° C. through the steel 325×2300 mesh wire filter cloth, before being dispensed into mould trays and solidified while cooling at room temperature. The colored ink compositions were characterized for thermal properties by DSC and for rheological properties using the Rheometrics RFS3 strain-controlled rheometer instrument.

The ink of Example 3a and the comparative ink were separately loaded into a modified Xerox® 8860 printer. Each ink was melted at 115° C. and jetted on to the DCEG glossy paper at 55° C. The paper with jetted ink was transported to a second modified Xerox® 8860 for a spreading process. The printer applied pressure of 800 pounds per square inch at an elevated temperature of 57.5° C. on the ink image at a speed of 1 letter-size paper per second. The Comparative ink process shown on the left picture of FIG. 3 illustrates that the ink resides on the paper surface. The ink process of the present disclosure shown on the right picture of FIG. 3 illustrates the ink penetration into the top coat layer of the coated paper.

Figure 4:
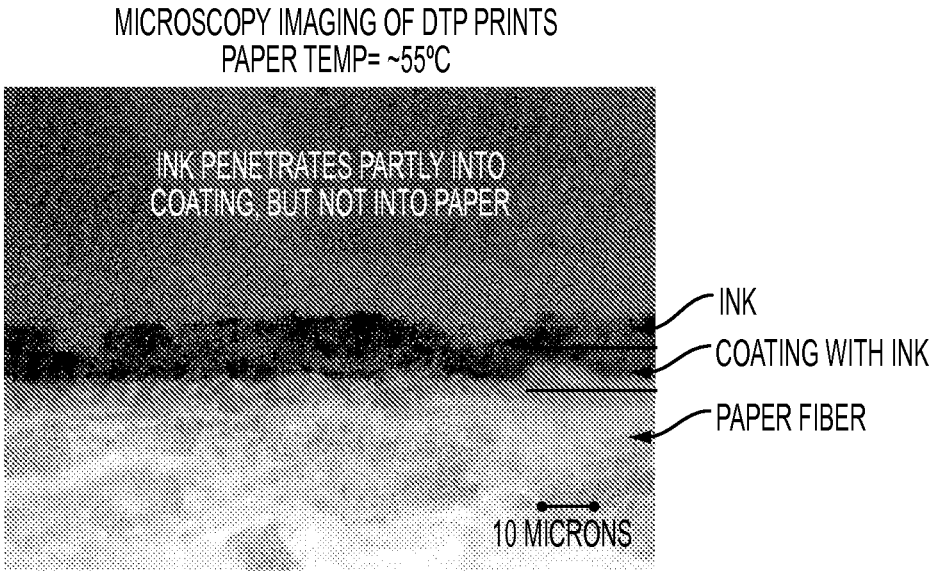
FIG. 4 is a photomicrograph showing ink penetration partly into paper top coat but not into paper substrate in accordance with a print process of the present disclosure.

FIG. 4 is a photomicrograph of the ink of Example 3a as described above, disposed in accordance with the present process. FIG. 4 shows ink penetration partly into the paper top coat but not into the paper substrate.

Figure 5:
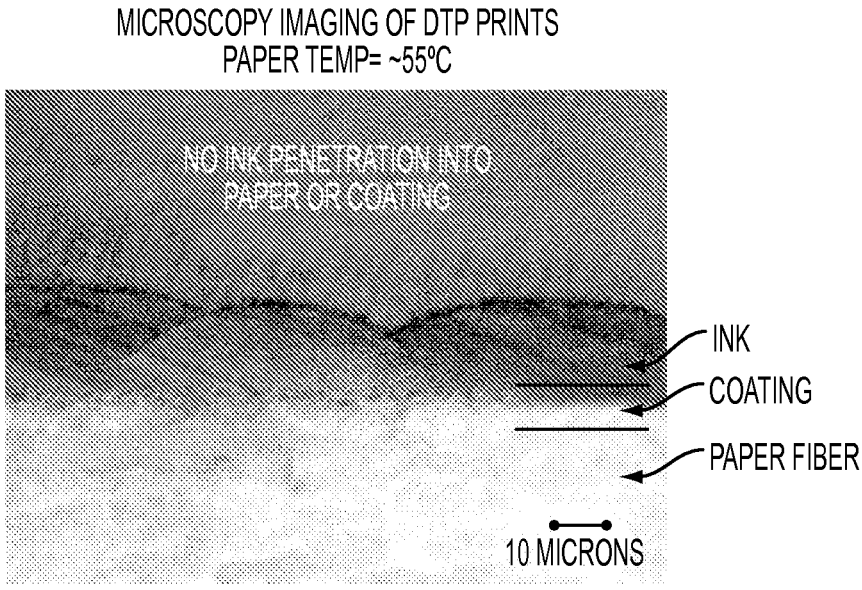
FIG. 5 is a photomicrograph showing no ink penetration into paper top coat or paper substrate in accordance with a comparative print process.

FIG. 5 is a photomicrograph of a printed image prepared with a currently available ink (Xerox® Part Number 108R00749) showing no ink penetration into paper top coat or paper substrate.

In embodiments, it is desired to maintain the molten state of the phase separation inks in the ink spreading zone. An image was printed in accordance with a comparative process wherein a first cyan layer is applied and a second magenta layer is separately applied over the first cyan layer wherein the substrate temperature is maintained at a temperature that is below the crystallization temperature of the magenta and cyan inks. A period of time of about 1 second elapsed between disposing the layers to allow the first ink layer to crystallize before the second ink layer was applied. This induced failure in gouge measurements due to poor ink to ink adhesions. Gouge measurement is a test employing a scratch/gouge finger with a curved tip at an angle of about 15° from vertical, with a weight of 528 grams applied, drawn across the image at a rate of approximately 13 millimeters/second. The scratch/gouge tip is similar to a lathe round nose cutting bit with radius of curvature of approximately 12 millimeters. In a successful ink test, no ink is visibly removed from the image. The upper magenta layer was removed during the gouge test, suggesting that the cyan and magenta inks did not coalesce.

An image was printed wherein a first cyan ink and a second magenta ink are applied simultaneously in a jetting zone onto a substrate with the cyan and magenta inks kept in a molten state, allowed to blend, and then the print imaged cooled so that the inks phase separate in accordance with a process of the present disclosure. This print was robust for gouge measurements. This print appeared more blue in color than the print of the preceding paragraph, suggesting that the two inks of had blended. In embodiments herein, the final image printed with the present process shows no visible loss of ink when subjected to a gouge test comprising drawing a gouge finger having a curved tip at an angle of about 15° from vertical with a weight of 528 grams across the final image at a rate of about 13 millimeters per second.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A process comprising:

disposing at least one phase separation ink in an imagewise fashion onto a final image receiving substrate to form an ink image, wherein disposing is at a first temperature at which the at least one phase separation ink is in a molten, unseparated state;

wherein the at least one phase separation ink comprises at least one crystalline component selected from compounds of the formula

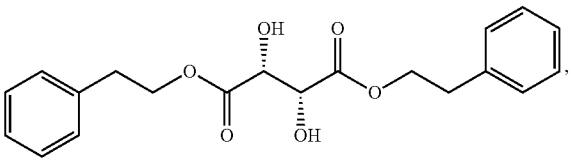

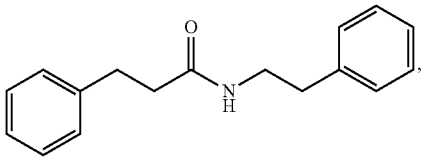

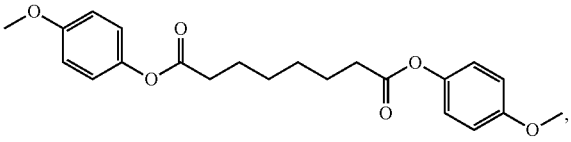

and

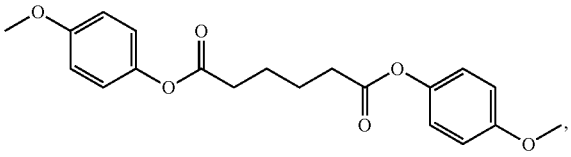

and wherein the at least one phase separation ink comprises at least one amorphous component selected from compounds of the formula

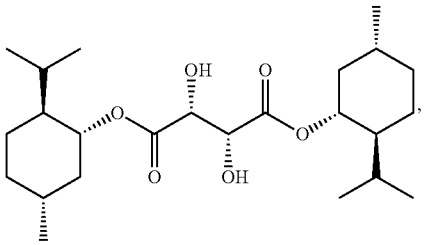

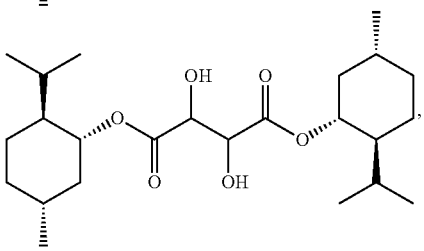

-continued

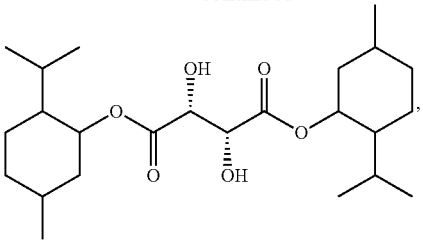

and

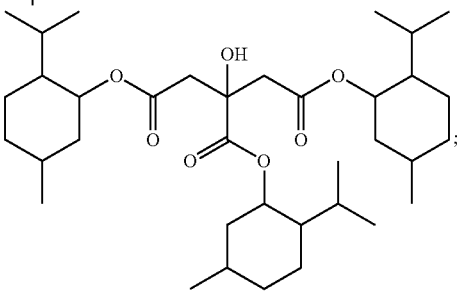

cooling the ink image to a second temperature sufficient to initiate crystallization of at least one component of the at least one phase separation ink, wherein at the second temperature the at least one phase separation ink comprises a crystalline phase and an amorphous phase;

applying pressure to the ink image on the final image receiving substrate; and allowing the ink to complete crystallization.

2. The process of claim 1, wherein disposing comprises disposing two or more phase separation inks of two or more different colors.

3. The process of claim 1, wherein disposing comprises ink jetting at least one phase separation ink; and optionally, wherein disposing comprises ink jetting two or more phase separation inks of two or more different colors.

4. The process of claim 1, wherein disposing is at a first temperature of from 100° C. to 140° C.

5. The process of claim 1, wherein cooling comprises cooling to a second temperature of from 20° C. to 80° C.

6. The process of claim 1, wherein applying pressure comprises applying a high pressure of 100 to 1,000 pounds per square inch for a period of from 1 millisecond to 10 milliseconds.

7. The process of claim 1, further comprising:

controlling the temperature of the final image receiving substrate to control the crystallization rate of the at least one phase separation ink.

8. The process of claim 1, further comprising:

controlling the temperature of the final image receiving substrate in an ink disposing zone to maintain the temperature of the final image receiving substrate in the ink disposing zone at a temperature that is higher than the crystallization temperature of the at least one phase separation ink.

9. The process of claim 1, further comprising:

controlling the temperature of the final image receiving substrate in an ink disposing zone to control the crystallization rate of the at least one phase separation ink by heating the final image receiving substrate using infrared radiation, conductive heating, carrier heating, or a combination thereof.

10. The process of claim 1, further comprising:

disposing the at least one phase separation ink at a third temperature that is higher than the first temperature, wherein the third temperature is from 60° C. to 180° C.

11. The process of claim 1, further comprising:

disposing the at least one phase separation ink at a third temperature that is higher than the first temperature at which the at least one phase separation ink is in a molten, unseparated state; and controlling the time that the ink image resides on the final image receiving substrate at the third temperature to achieve a desired amount of phase separation of multilayers of phase separation ink.

12. The process of claim 1, wherein the final image receiving substrate is coated paper.

13. The process of claim 1, wherein the final image receiving substrate comprises a base layer, a top coat layer disposed over a first surface of the base layer; and, optionally, a bottom coat layer disposed over a second, opposite surface of the base layer;

wherein the ink image is disposed on the top coat layer.

14. The process of claim 1, further comprising:

employing a release agent to reduce or eliminate ink offset.

15. The process of claim 1, wherein the final image shows no visible loss of ink when subjected to a gouge test comprising drawing a gouge finger having a curved tip at an angle of 15° from vertical with a weight of 528 grams across the final image at a rate of 13 millimeters per second.

16. A process which comprises:

(1) incorporating into an ink jet printing apparatus at least one phase separation ink;

wherein the at least one phase separation ink comprises at least one crystalline component selected from compounds of the formula

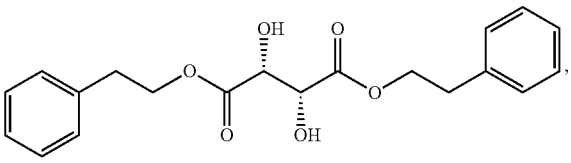

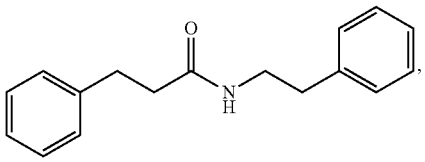

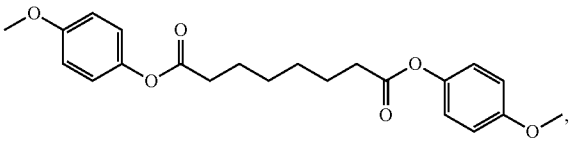

and

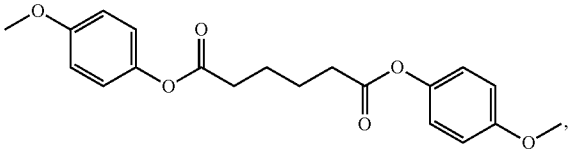

and wherein the at least one phase separation ink comprises at least one amorphous component selected from compounds of the formula

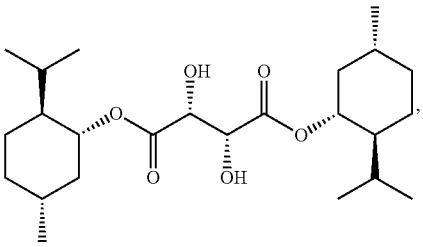

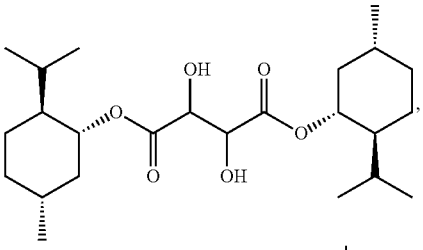

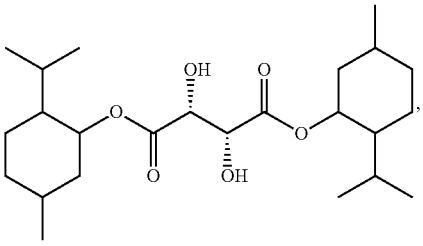

and

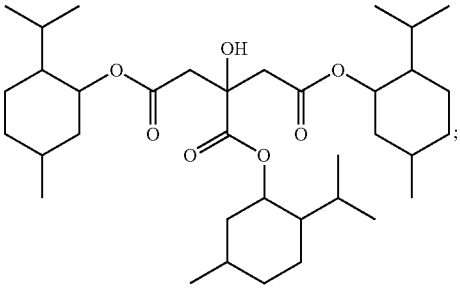

(2) heating the at least one phase separation ink to a first temperature at which the at least one phase separation ink is in a molten, unseparated state;

(3) causing droplets of the at least one phase separation ink to be ejected in an imagewise pattern onto an image receiving substrate, wherein the image receiving substrate is an intermediate transfer member or a final image receiving substrate;

(4) cooling the ink image to a second temperature sufficient to initiate crystallization of at least one component of the at least one phase separation ink, wherein the at least one phase separation ink comprises a crystalline phase and an amorphous phase;

(5) optionally transferring the ink image from an intermediate transfer member to a final image receiving substrate;

(6) applying pressure to the ink image on the final image receiving substrate; and (7) allowing the ink to complete crystallization.

17. The process of claim 16, further comprising:

controlling the temperature of the final image receiving substrate to control the crystallization rate of the at least one phase separation ink.

18. The process of claim 16, wherein the final image receiving substrate comprises a base layer, a top coat layer disposed over a first surface of the base layer; and, optionally, a bottom coat layer disposed over a second, opposite surface of the base layer;

wherein the ink image is disposed on the top coat layer.

* * * * *